United States Patent [19]

Freed

[11] Patent Number: 4,697,492

[45] Date of Patent: Oct. 6, 1987

[54] STRINGED MUSICAL INSTRUMENTS WITH MAGNETIC PICKUPS

[75] Inventor: Mark L. Freed, Santa Monica, Calif.

[73] Assignee: Diversco, Inc., Los Angeles, Calif.

[21] Appl. No.: 850,257

[22] Filed: Apr. 11, 1986

[51] Int. Cl.[4] ..... G10H 3/18; G10D 3/06

[52] U.S. Cl. ..... 84/1.16; 84/DIG. 30; 84/314 R

[58] Field of Search ..... 84/1.16, 314 R, 293, 84/DIG. 27, DIG. 30, 1.15

*Primary Examiner*—S. J. Witkowski
*Assistant Examiner*—David Warren
*Attorney, Agent, or Firm*—Philip D. Junkins

[57] ABSTRACT

Electric stringed musical instruments having an elongated fingerboard, an upper headpiece and nut and a lower tailpiece and bridge, with a first set of primary frets placed in regular sequence along the fingerboard from its upper end to is lower end and a set of secondary frets each placed intermediate a pair of primary frets along the fingerboard. Each secondary fret is so placed between two primary frets that upon depression of a string of the instrument between any selected pair of frets comprising a primary fret and an adjacent secondary fret, accompanied by plucking or strumming of the string, two harmonically resolved musical notes are generated. One of such notes is related to the length of the portion of the string between the lower fret of the selected pair of frets and the lower bridge of the instrument and is picked up by a pickup head of a lower magnetic pickup assembly. The other of such notes is related to the length of the portion of the string between the upper fret of the selected pair of frets and the upper nut of the instrument and is picked up by a pickup head of an upper pickup assembly located on the upper end of the fingerboard. In effect, bi-directional musical notes are created on each string with the plucking or strumming thereof and a unique harmonious musical stereo-effect is generated.

7 Claims, 3 Drawing Figures

STRINGED MUSICAL INSTRUMENTS WITH MAGNETIC PICKUPS

BACKGROUND OF THE INVENTION

1. Field of the Invention

The present invention relates generally to stringed musical instruments and method of playing same and more particularly to stringed musical instruments having an elongated fretted fingerboard with a plurality of tensioned strings, immedediately above the fingerboard, which are strummed or plucked with a pick or with the fingers.

2. Description of the Prior Art

Stringed musical instruments which are plucked have been known for nearly 3,000 years with earliest origins in the Middle East and the Orient. The most popular fretted instrument in the United States has been the "guitar." The guitar usually has 6 strings but may have as few as 4 (base guitar) and as many as 12 strings. Other fretted, stringed instruments of the guitar family include: the "lute," popular in Europe during the 1500's and 1600's (6 strings); the "balalaika" with Russian origin (2–4 strings); the "mandolin" (4–5 double strings of wire); the "banjo" (4 or more strings) with its drumlike body and long fretted neck; the "ukulele," a small guitar of Portugues origin popularized in Hawaii (typically has 4 strings); and the "Spanish guitar" of Spanish origin in the early 1500's.

The modern guitar is comprised basically of an elongated fingerboard or neck terminating in an upper headpiece which includes a number of string tensioning members (tuning pegs). The fingerboard bears a series of spaced frets (narrow metal cross strips) against which the strings are stopped (pressed) to vary the effective length of the strings and thus the musical sound of the strings. Commonly, guitars are provided with 20 to 26 frets. The fingerboard terminates at its lower end in a tailpiece or soundboard. The strings are tensioned over the fingerboard, and its frets, between a headpiece nut and the tailpiece bridge. The lower ends of the strings, beyond the bridge, are anchored in known manner to the tailpiece. The upper ends of the strings, beyond the nut, are attached to the tuning pegs of the headpiece.

The great majority of present-day guitars, and instruments of the guitar family, include electronic means and systems for amplifying the musical notes produced by the vibrations of the strings when actuated as by being plucked by a plectum (pick) or strummed by the player's fingers. In electric guitars, the sound amplifying means usually comprises a set of magnetic pickups, each pickup being situated close to (most often directly under) a string, and the electric outputs of the pickups are fed to electric amplifier devices of well-known design. The set of pickups is located on the tailpiece between the bridge and the nearest fret on the fingerboard.

It is a principal object of the present invention to provide novel construction of electric stringed musical instruments.

It is a further principal object of the invention to provide a unique method of playing the electric stringed musical instrument of the invention.

It is a still further object of the invention to provide novel construction of electric guitars and other stringed musical instruments having elongated fretted fingerboards.

It is another object of the invention to provide a unique method of playing electric guitars and other stringed musical instruments having elongated fretted fingerboards of the type of the present invention.

Other objects and advantages of the invention will become apparent from a reading of the following summary and detailed description of a preferred embodiment of the invention, taken in connection with the accompanying drawings.

SUMMARY OF THE INVENTION

The present invention relates to unique and improved electric stringed musical instruments having elongated fretted fingerboards and to the method of playing same. As previously described, the typical electric stringed instrument of the guitar family has a set of magnetic pickups located on the tailpiece or soundboard between the bridge and the nearest fret on the fingerboard. The musical notes and chords that are picked up are those generated by string vibrations between the fret upon which a given string is depressed (stopped) and the bridge.

The stringed musical instruments of this invention have an additional or secondary set of frets on the fingerboard interposed between the standard or primary set of frets and a secondary set of magnetic pickups located on the fingerboard adjacent the headpiece of the instrument. The instruments are played by depressing (stopping) the strings between a primary fret and a secondary fret whereby a depressed string, although tapped, plucked or strummed in the area between the stopping frets and the bridge, generates string vibrations in two directions and of two different amplitudes. Thus, two different (but harmonically related) notes are created, one of which is picked up by a magnetic pickup of the primary set of pickups and the other of which is picked up by a magnetic pickup of the secondary set of pickups. The unique fingerboard and fret arrangement with magnetic pickup sets at each end of the fingerboard allows the musician to sound two notes simultaneously when tapping, plucking or strumming one string, four notes when tapping, plucking or strumming two strings, and so on. Further, the musician can obtain note octives on one string at the same time and can superimpose single notes above sustained chords which are normally silent and muted. In effect, bi-directional notes are created on each string with each tapping, plucking or strumming thereof and a unique harmonious musical stereo-effect is generated.

DETAILED DESCRIPTION OF PREFERRED EMBODIMENTS OF THE INVENTION

Figure 1:
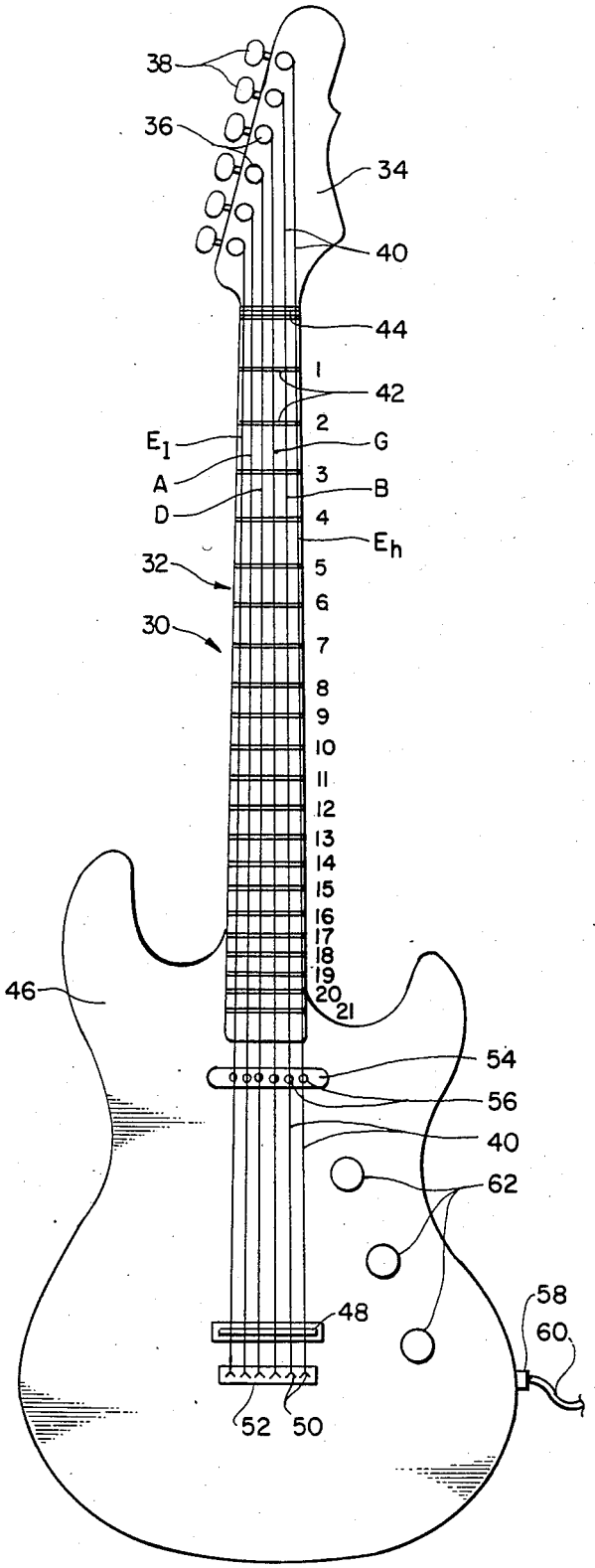
FIG. 1 is a front view of an electric guitar of the type in general use at the present time showing a typical arrangement of frets along the fingerboard and a set of magnetic pickups on the tailpiece of the instrument.

Referring initially to FIG. 1, there is shown a typical electric guitar as an example of a stringed musical instrument having an elongated fretted fingerboard. The exemplary guitar, generally indicated by the number 30, is comprised of an elongated fingerboard 32 terminating at its upper end in a headpiece 34 which includes a number of string tensioning members 36 (pegs) which are adjusted in their rotation and string tensioning function by their respective tuning knobs 38. There is one member (peg) 36 and respective tuning knob 38 for each of the strings 40. Fingerboard 32 is provided with a series of frets 42, each comprising a transverse and raised rib on the upper surface of the fingerboard. The guitar illustrated in FIG. 1 includes 21 frets numbered 1 to 21 with fret number 1 located near the nut 44 at the upper end of the fingerboard at the point where the fingerboard 32 joins with the headpiece 34. Fret number 21 is located as the last fret at the lower end of the fingerboard where the fingerboard joins the tailpiece or soundboard 46 of the guitar 30. Substantially all fretted, stringed musical instruments have their frets placed along their fingerboards in accordance with a repeating mathematical progression based upon the placement of the 12th fret, counting from the nut position, at a point half-way between the nut and the bridge. The 5th fret and the 24th fret (if utilized) are at the quarter divisions between the nut and bridge. The 7th fret and the 19th are located at positions from the nut and bridge, respectively, one-third of the distance from the nut to the bridge. The total distance between any five frets is the same as the total distance between the following seven frets. Thus, the distance between the nut and the 5th fret is equal to the distance between the 5th fret and the 12th fret and the distance between the 7th fret and the 12th fret is equal to the distance between the 12th fret and the 19th fret. The strings 40 extend from their respective tensioning pegs 36, over nut 44 (appropriately grooved to maintain string spacing), in parallel along the fingerboard 32 (over the spaced frets 42), to and over bridge 48 (located at the lower end of the tailpiece 46) and finally to their respective anchor points 50 on and within anchor member 52 on the tailpiece 46. The bridge 48 is appropriately grooved to maintain string spacing at the soundboard end of the guitar.

Mounted on the tailpiece or soundboard 46, below strings 40, is a magnetic pickup assembly indicated generally at 54 and comprised of individual pickups 56 located below the strings 40. As is well known in the art, the magnetic pickup assembly 54 serves to produce electric signals which are a function of the musical notes produced by the strings on the fingerboard 32, and feeds out signals (as a function of the musical notes) through a plug 58 and a cable 60 to an electrical amplifier (not shown) of known design. The pickup assembly 54 may be provided with appropriate on-off, tone and volume control knobs 62. The magnetic pickup assembly 54, individual pickups 56, plug 58, cable 60 and control knobs 62 are conventional and well known in the electronic stringed musical instrument art.

As previously noted, the strings 40, six in number, extend over substantially the entire length of the guitar from their respective anchor points 50 on and within the anchor member 52 to their respective tensioning members 36 and, as is conventional, the strings 40 extend slightly above the frets 42 formed on the upper surface of the fingerboard 32. For a six string guitar of the type illustrated in FIG. 1 the strings are typically tuned in the sequence $E_l$, A, D, G, B and $E_h$ from low E ($E_l$) to high E ($E_h$). The G, B and $E_h$ strings are usually single wires of progressively (G to $E_h$) smaller diameter with the $E_h$ string of highest musical pitch. The $E_l$, A and D strings are usually dual wound strings of progressively (D to $E_l$) larger diameter with the $E_l$ string of lowest musical pitch. As is well known in the fretted, stringed musical instrument art, note variations for each string are attained by depressing (stopping) the string to a given fret. As a string is depressed (stopped) to a selected fret nearer the tailpiece the note produced by tapping, plucking or strumming the string between the stopping fret and the bridge is higher in tone and the individual magnetic pickup beneath such string picks up the higher note. Depression of each string to a stopping fret is accomplished by finger pressure applied to the string behind the stopping fret. Thus, if it is desired to stop the B string on fret number 5 the B string is depressed between the 4th and 5th fret.

Figure 2:
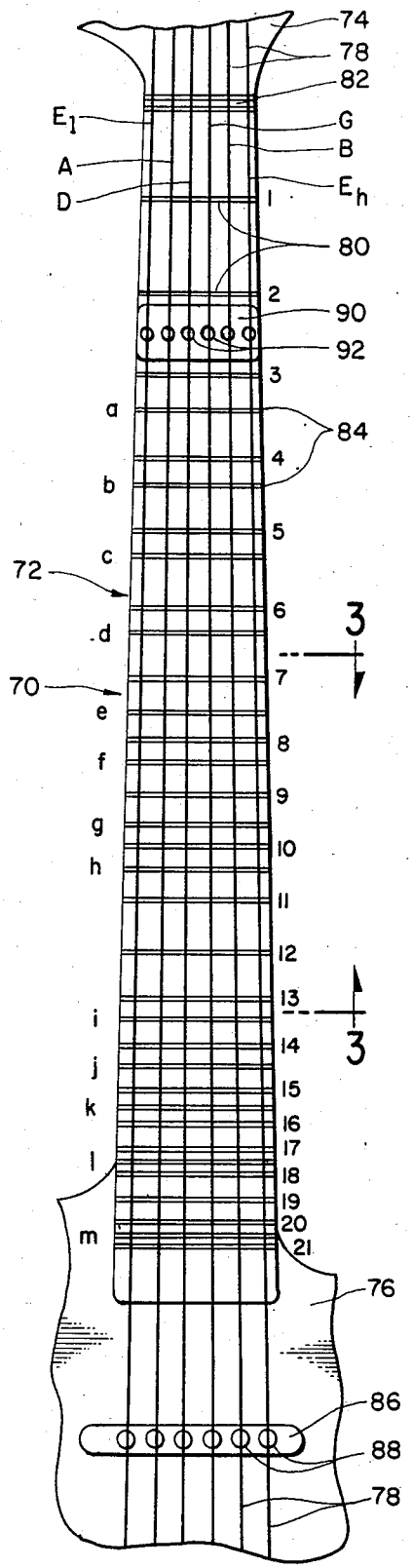
FIG. 2 is a front view of the fingerboard section of a guitar of the present invention showing the standard set of frets and an interposed secondary set of frets along the fingerboard and a secondary set of magnetic pickups on the fingerboard near the headpiece of the instrument.

Referring now to FIG. 2, there is shown, in an enlarged front view, the fingerboard section of a guitar of the present invention. The guitar, generally indicated by the number 70, is comprised of an elongated fingerboard 72 terminating at its upper end in a headpiece 74 (not shown in full) and at its lower end in a tailpiece 76 (not shown in full). Appropriate string tensioning members and their respective tuning knobs are provided, as with the guitar headpiece of FIG. 1, for strings 78. Fingerboard 72 is provided with a first series of standard or primary frets 80, each comprised of a transverse and raised rib on the upper surface of the fingerboard. As illustrated in FIG. 2, the first set of twenty-one standard frets numbered 1 to 21 are placed in the same position along the fingerboard as the twenty-one frets of the guitar of FIG. 1. Again, fret number 1 is located near nut 82 at the upper end of the fingerboard with fret number 21 located as the last fret at the lower end of the fingerboard. Also located on the fingerboard 72 is a series of secondary frets 84 selectively interposed between the standard or primary frets 80. This secondary series of frets includes, as illustrated, thirteen frets numbered a to m and, as described hereinafter, cooperate with frets 1 to 21 to create the unique bi-directional, harmonic musical tone effects produced by the fretted, stringed musical instruments of the invention.

The strings 78 extend from their respective tensioning pegs (not shown) on the headpiece 74, over nut 82 (appropriately grooved to maintain string spacing), in parallel along the fingerboard 72 (over the first series of frets 80 and over the interposed second series of frets 84), to and over a bridge (not shown) on the tailpiece 76 and finally to their respective anchor points (not shown) on the tailpiece. Mounted on the tailpiece or soundboard 76, below strings 78, is a first or primary magnetic pickup assembly indicated generally at 86 and comprised of individual pickups 88 located below the strings 78. Mounted on the upper end of the fingerboard 72 (in accordance with the invention), below strings 78, is a second or secondary magnetic pickup assembly indicated generally at 90 and comprised of individual pickups 92 located below strings 78. As in the case of the standard electric guitar illustrated in FIG. 1, the magnetic pickup assembly 86 is of a type well known in the art and serves to produce electric signals which are a function of the musical notes produced by the strings on the fingerboard over the respective individual pickups 88, and feeds out signals (as a function of the musical notes at each pickup point) through a cable (not shown) to an electric amplifier (not shown) of known design. In like fashion, the magnetic pickup assembly 90 is of well known design and serves to produce electric signals which are a function of the musical notes produced by the strings on the fingerboard over the respective individual pickups 92 with such signals fed by cable to the amplifier. Each of the pickup assemblies 86 and 90 may be provided with appropriate on-off, tone and volume controls (not shown) located in a convient area on the tailpiece or soundboard 76.

In accordance with the unique dual fret series on the fingerboard and the dual pickup assemblies of the fretted, stringed musical instrument of the invention, either a single note or bi-directional notes may be produced by each string. If a given string is merely plucked or strummed without depression of such string to a fret, the basic note sound of the string is picked up by the respective individual pickups of both pickup assemblies 86 and 90. If a string is depressed between adjacent frets of the two series of frets, a different note is generated by the string in opposing directions from the adjacent frets. For example, if string B between the number 11 fret and the letter h fret is depressed to stop the string against such frets (and such string is plucked in normal fashion), the string note generated between fret 11 and the bridge (lower direction) is B♭ picked up by pickup assembly 86 and the note generated by such string between fret h and the nut 82 (upper direction) is C♯ picked up by pickup assembly 90.

The placement of the secondary series of frets (a–m as illustrated in FIG. 2) within the primary series of frets (1–21 as illustrated in FIG. 2) on the fingerboard is dictated by the resolution of musical note harmony between the bi-directional notes generated from the adjacent primary and secondary frets. It will be noted that, for the exemplary guitar fingerboard of FIG. 2, there are no secondary frets between primary frets 11 and 12, 12 and 13, 18 and 19, and 19 and 20. In accordance with the invention, it has been discovered that between these primary fret pairs no bi-directional notes can be generated by the placement of a secondary fret which will be in harmony, i. e., with the placement of a secondary fret between these primary fret pairs only dissonant bi-directional notes or notes that are disconcordant (harmonically unresolved) are produced. It is also a part of the present discovery and invention that with the upper fingerboard placement of a secondary pickup assembly without placement of a secondary series of frets, harmonically unresolved notes are picked up by the dual pickup assemblies.

It should be noted (by reference to FIG. 2) that no secondary frets are placed between the nut and number 1 fret, between the number 1 and the number 2 fret and between the number 2 and number 3 fret. It is impractical to place secondary frets on the fingerboard in these spaces because any note generated in the direction of the nut from such frets would be in the inaudible range. It is also to be understood that the magnetic pickup assembly 90 may be located between the nut and the number 1 fret or between the number 1 and the number 2 frets, as well as between the number 2 and the number 3 frets as shown in FIG. 2. Also, the magnetic pickup assembly 90 need not be aligned transverse the direction of the strings. Rather, it may lie in an angular orientation with respect to the strings so long as one individual pickup of such assembly is aligned with each string.

Figure 3:
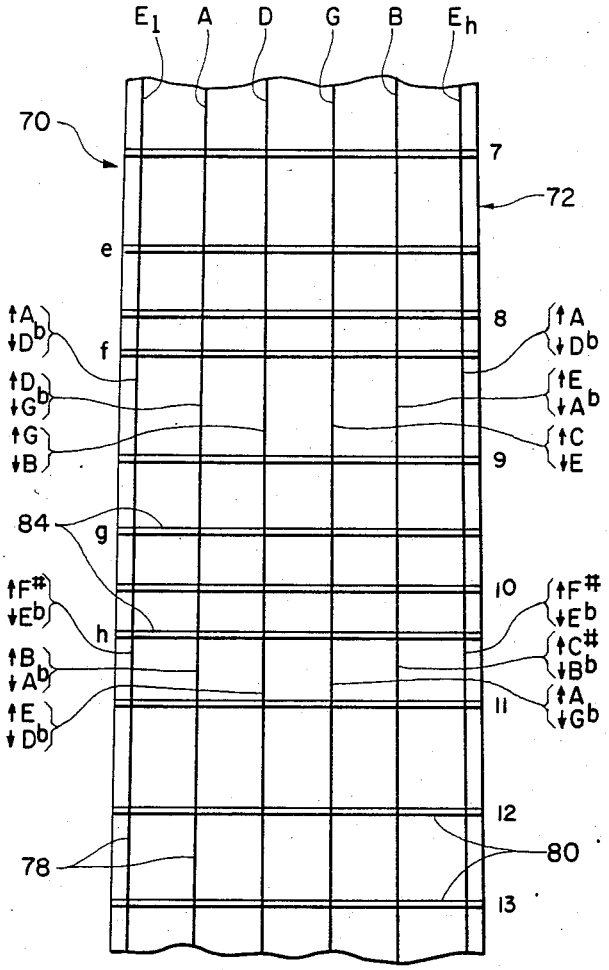
FIG. 3 is an enlarged front view of a middle segment of the fingerboard of the guitar of FIG. 2 between standard fret 7 and standard fret 13 of such guitar.

FIG. 3 is an enlarged view of the middle section of the fingerboard of the guitar 70 of FIG. 2 of the invention. Standard frets 7 through 13 are illustrated on the fingerboard 72 and secondary frets e through h are shown interposed between frets 7 through 11. The following table shows the bi-directional lower and upper harmonically resolved notes that are derived and picked up by the lower magnetic pickup assembly 86 and the upper magnetic pickup assembly 90 for each string when depressed (stopped) between the f and 9 frets and between the h and 11 frets and picked or strummed.

| | f - 9 Frets | | h - 11 Frets | |
|---|---|---|---|---|
| String | Lower | Upper | Lower | Upper |
| $E_l$ | $D^b$ | A | $E^b$ | F♯ |
| A | $G^b$ | D | $A^b$ | B |
| D | B | G | $D^b$ | E |
| G | E | C | $G^b$ | A |
| B | $A^b$ | E | $B^b$ | C♯ |
| $E_h$ | $D^b$ | A | $E^b$ | F♯ |

There is thus provided a totally new and unique fretted, stringed musical instrument that generates string vibrations in two directions and of different note amplitudes. Thus, with the plucking or strumming of each string two different, but harmonically resolved (related) notes are created, one of which is picked up by a primary magnetic pickup (lower) and the other of which is picked up by a secondary magnetic pickup (upper). The dual series fret arrangement allows the musician to sound two notes simultaneously from one string. Further, the musician can obtain note octives on one string at the same time and can superimpose single notes above sustained chords which are normally silent or muted. Through the instrument, bi-directional notes are generated on each string and a unique harmonious musical stereo-effect is created.

It is to be noted that a number of fretted stringed instruments (particularly guitar-type instruments) have been designed with dual (parallel) fretted fingerboards and thus have dual headpieces and tailpieces or soundboards. The present invention, relating to the use of a secondary set of frets on a fingerboard and a secondary magnetic pickup assembly located on the fingerboard near the headpiece, includes the application of such features and structures to dual fingerboards, headpieces and tailpieces in any form of fretted stringed instrument.

In the specification and drawing figures there has been set forth a preferred embodiment of the invention and although specific terms have been employed, they are used in a generic and descriptive sense only and not for purposes of limitation, the scope of the invention being defined in the following claims.

What I claim is:

1. In a stringed musical instrument, in combination:

(a) an instrument body including an elongated fretted fingerboard, a headpiece extending upwardly from the fingerboard and a tailpiece extending downwardly from the fingerboard;

(b) a plurality of selectively adjustable string tensioning members mounted on said headpiece;

(c) a plurality of strings extending parallel to and above the front face of the fingerboard, each string being attached at its upper end to one of said tensioning members and being anchored at its lower end to said tailpiece;

(d) a set of primary frets placed in regular sequence along the fingerboard, transverse of said strings;

(e) a first magnetic pickup assembly carried by said tailpiece and including a plurality of magnetic pickup heads, each adjacent to and in operative relationship with one of said strings;

(f) a second magnetic pickup assembly carried by said fingerboard in proximity with said headpiece and including a plurality of magnetic pickup heads, each adjacent to and in operative relationship with one of said strings; and (g) a set of secondary frets each placed intermediate a pair of primary frets along the fingerboard, transverse of said strings; each secondary fret being so placed between two primary frets that upon depression of a string of the instrument between any primary fret and an adjacent secondary fret, accompanied by a tapping, plucking or strumming of said string, two harmonically resolved, bi-directional musical notes will be generated through said string with one of said notes picked up by a pickup head of the first magnetic pickup assembly carried by the tailpiece and the other of said notes picked up by a pickup head of the second magnetic pickup assembly carried by the fingerboard in proximity with said headpiece.

2. The stringed musical instrument as claimed in claim 1 wherein said instrument has at least 2 strings, at least 2 primary frets and at least 1 secondary fret.

3. The stringed musical instrument as claimed in claim 1 wherein said instrument has from 4 to 12 strings, from 18 to 26 primary frets and from 10 to 14 secondary frets.

4. A stringed musical instrument comprising:

(a) an elongated body member including a fretted fingerboard, a headpiece extending upwardly from the fingerboard and a tailpiece extending downwardly from the fingerboard;

(b) a string supporting nut extending across the fingerboard at its upper end and a string supporting bridge mounted on said tailpiece;

(c) a plurality of selectively adjustable string tensioning members mounted on said headpiece in laterally spaced relation;

(d) a plurality of strings extending parallel to and above the front face of the fingerboard, each string extending over said supporting nut and attached at its upper end to one of said tensioning members and extending over said bridge and anchored at its lower end to said tailpiece;

(e) a set of primary frets placed in regular sequence along the fingerboard from its upper end to its lower end, transverse of said strings;

(f) a first magnetic pickup assembly carried by said tailpiece between the last primary fret and said bridge, including a plurality of magnetic pickup heads, each adjacent to and in operative relationship with one of said strings;

(g) a second magnetic pickup assembly carried by said fingerboard in proximity with said headpiece and at a point lower than said nut, including a plurality of magnetic pickup heads, each adjacent to and in operative relationship with one of said strings; and (h) a set of secondary frets each placed intermediate a pair of primary frets along the fingerboard, transverse of said strings, each secondary fret being so placed between two primary frets that upon depression of a string of the instrument between any selected pair of frets comprising a primary fret and an adjacent secondary fret, accompanied by tapping, plucking or strumming of said string, two harmonically resolved, bi-directional musical notes will be generated through said string with one of said notes related to the length of the portion of said string between the lower fret of said selected pair of frets and the bridge and picked up by a pickup head of the first magnetic pickup assembly carried by the tailpiece and with the other of said notes related to the length of the portion of said string between the upper fret of said selected pair of frets and the nut and picked up by a pickup head of the second magnetic pickup assembly carried by the fingerboard in proximity with said headpiece.

5. The stringed musical instrument as claimed in claim 4 wherein said instrument has at least 2 strings, at least 2 primary frets and at least 1 secondary fret.

6. The stringed musical instrument as claimed in claim 4 whrein said instrument has from 4 to 12 strings, from 18 to 26 primary frets and from 10 to 14 secondary frets.

7. In a stringed musical instrument, in combination:

(a) an instrument body including at least one elongated fretted fingerboard, a headpiece extending upwardly from each fingerboard and a tailpiece extending downwardly from each fingerboard;

(b) a plurality of selectively adjustable string tensioning members mounted on each of said headpieces;

(c) a plurality of strings extending parallel to and above the front face of each fingerboard, each string being attached at its upper end to one of said tensioning members of each headpiece and being anchored at its lower end to its respective tailpiece;

(d) a set of primary frets placed in regular sequence along each of the fingerboards, transverse of said strings;

(e) a first magnetic pickup assembly carried by each of said tailpieces and including a plurality of magnetic pickup heads, each adjacent to and in operative relationship with one of said strings;

(f) a second magnetic pickup assembly carried by each of said fingerboards in proximity with said headpiece and including a plurality of magnetic pickup heads, each adjacent to and in operative relationship with one of said strings; and (g) a set of secondary frets on each fingerboard each placed intermediate a pair of primary frets along the fingerboard, transverse of said strings, each secondary fret being so placed between two primary frets that upon depression of a string of the instrument between any primary fret and an adjacent secondary fret, accompanied by a tapping, plucking or strumming of said string, two harmonically resolved, bi-directional musical notes will be generated through said string with one of said notes picked up by a pickup head of the first magnetic pickup assembly carried by the tailpiece to which said string is anchored and the other of said notes picked up by a pickup head of the second magnetic pickup assembly carried by the fingerboard in proximity with the headpiece bearing the tensioning member to which said string is attached.

* * * * *